US007531494B2

(12) United States Patent
Gardiner et al.

(10) Patent No.: US 7,531,494 B2
(45) Date of Patent: May 12, 2009

(54) FABRIC TREATMENT COMPOSITION WITH A FABRIC SUBSTANTIVE DYE

(75) Inventors: Elaine Hunter Gardiner, Newcastle Upon Tyne (GB); Xiaotian Zou, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/983,555

(22) Filed: Nov. 8, 2007

(65) Prior Publication Data

US 2008/0109968 A1 May 15, 2008

Related U.S. Application Data

(60) Provisional application No. 60/858,099, filed on Nov. 10, 2006.

(51) Int. Cl.
*C11D 17/06* (2006.01)
*C11D 11/02* (2006.01)

(52) U.S. Cl. ..... 510/349; 8/137; 8/641; 8/687

(58) Field of Classification Search ..... 510/349; 8/115.51, 636, 137, 641, 687
See application file for complete search history.

(56) References Cited

U.S. PATENT DOCUMENTS 3,755,201 A * 8/1973 Trimmer et al. ..... 510/324
6,025,319 A * 2/2000 Surutzidis et al. ..... 510/441

FOREIGN PATENT DOCUMENTS

DE 10360842 A1 12/2004
WO WO 99/07817 2/1999
WO WO 2005/003274 * 1/2005

OTHER PUBLICATIONS

PCT International Search Report Dated Nov. 10, 2006—5 pgs.

* cited by examiner

*Primary Examiner*—Lorna M Douyon
*Assistant Examiner*—Amina Khan
(74) *Attorney, Agent, or Firm*—David V. Upite; Mark A. Charles; Kim William Zerby

(57) ABSTRACT

A fabric treatment composition comprising from about 0.0001% to about 0.01% by weight of a fabric substantive dye loaded onto a particle carrier having an average particle size of less than 100 μm is disclosed. The process for making the fabric treatment composition is described. A fabric substantive dye-loaded particle carrier having an average particle size of less than 100 μm and comprising from about 0.001% to about 1% by weight of a fabric substantive dye is described.

8 Claims, No Drawings

FABRIC TREATMENT COMPOSITION WITH A FABRIC SUBSTANTIVE DYE

CROSS REFERENCE TO RELATED APPLICATION

This application claims the benefit of U.S. Provisional Application No. 60/858,099 filed Nov. 10, 2006.

FIELD OF THE INVENTION

The present invention relates to a fabric treatment composition comprising a fabric substantive dye. Specifically, the present invention relates to a fabric treatment composition comprising a fabric substantive dye which imparts a favorable hue to fabrics without staining the fabrics treated.

BACKGROUND OF THE INVENTION

Wearing and laundering of fabric articles can result in a discoloration of the fabric articles from the original fabric color. For example, white fabrics which are repeatedly laundered can exhibit a yellowish appearance which makes the fabric look older and worn. To overcome the undesirable yellowing of white fabrics, and similar discoloration of other light colored fabrics, it is desirable to formulate a fabric substantive dye in a fabric treatment composition to impart a favorable hue to the fabrics treated.

However, one problem associated with formulating a fabric substantive dye into a fabric treatment composition is the risk of staining the fabric due to the substantive nature of the dyestuff to the fabric. Without intending to be bound by theory, it is believed that the staining issues are caused by the high concentration of the dyestuff at a certain point in the fabric treatment composition, which typically occurs when the fabric substantive dye is formulated into a fabric treatment composition in the form of speckles. In addition, another problem associated with formulating a fabric substantive dye is that the finished fabric treatment composition product is colored by the dyestuff at the level required to give the hueing effect, which is sometimes undesirable from the product aesthetic point of view.

Accordingly, the need exists for a fabric treatment composition which imparts a favorable hue to fabrics without staining such fabrics. In addition, the need exists for a fabric treatment composition which imparts a favorable hue to fabrics without coloring the finished fabric treatment compositions.

SUMMARY OF THE INVENTION

The present invention provides a fabric treatment composition containing from about 0.0001% to about 0.005% by weight of a fabric substantive dye, wherein the fabric substantive dye is loaded onto a particle carrier having an average particle size of less than about 100 μm, and wherein the fabric treatment composition comprises from about 0.01% to about 12% by weight of the fabric substantive dye-loaded carrier. It has been surprisingly found that by loading the fabric substantive dye onto a fine particle carrier having the specified average particle size, and then adding the dyestuff-loaded particle carriers into a fabric treatment composition in the specified amount, a desired hue can be imparted to fabrics treated with such composition without staining the fabrics. Without intending to be bound by theory, it is believed that the small particle size of the particle carriers ensures that the fabric substantive dye loaded thereon distributes evenly throughout the fabric treatment composition and avoids concentrating the dyestuff in a single point of the fabric treatment composition. As a result, the staining issue associated with formulating fabric substantive dye into a fabric treatment composition is solved. In addition, the even distribution of the fabric substantive dye throughout the fabric treatment composition ensures that the dyestuff does not concentrate and color the fabric treatment composition per se.

In another aspect of the present invention, a process for making a fabric treatment composition comprising a fabric substantive dye is described. The process includes the steps of spraying a liquid fabric substantive dye or its solution onto a particle carrier and mixing to give a fabric substantive dye loaded-particle which is then added into a surfactant containing base powder of a fabric treatment composition.

In still another aspect of the present invention, a fabric substantive dye-loaded particle carrier having an average particle size of less than 100 μm and comprising from about 0.001% to about 1% by weight of a fabric substantive dye is provided. The fabric substantive dye-loaded particle carrier is useful as an additive of a fabric treatment composition to impart a desirable hue to the fabric.

DETAILED DESCRIPTION OF THE INVENTION

Unless otherwise specified, all percentages, ratios or parts herein are on a weight basis.

Surfactant containing base powder of the fabric treatment composition is used herein to describe all the intermediate products of the fabric treatment composition before the fabric substantive dye-loaded particle carrier is added into the fabric treatment composition.

The fabric treatment compositions herein are used to treat laundry items. Such compositions can be a laundry detergent composition used for washing fabrics and a laundry fabric softener used for softening or conditioning fabrics. The compositions may be in the form of a solid, either in tablet or granular form. Preferably, the fabric treatment compositions herein are granular laundry detergent compositions.

Fabric Substantive Dye

As used herein, "fabric substantive dye" includes a reactive dye, a direct dye and an acid dye. The fabric substantive dye is included in the fabric treatment composition in an amount sufficient to provide a desirable hue to fabrics treated in a solution containing the fabric treatment composition. On the other hand, because the dyestuff is substantive to fabrics, only a small amount is required to impart a desirable hue to fabrics. In one embodiment, the fabric treatment composition comprises from about 0.0001% to about 0.005%, or from about 0.0002% to about 0.001% by weight of a fabric substantive dye.

It is preferable that the fabric substantive dyes herein have a blue, violet and/or pink shade. This means that the peak absorption frequency of the dye absorbed on the cloth lies within the range of from 500 nm to 700 nm, or from 540 nm to 640 nm. It is also possible that the same effect can be achieved by a combination of dyes, each of which not necessarily having a peak absorption within these preferred ranges but together produce an effect on the human eye which is equivalent to a single dye with a peak absorption within one of the preferred ranges.

Dyes are conventionally defined as being acid, basic, reactive, disperse, direct, vat, sulphur or solvent dyes, etc. For the purposes of the present invention, direct dyes, acid dyes and reactive dyes are preferred, direct dyes are most preferred. Direct dye is a group of water-soluble dye taken up directly by fibers from an aqueous solution containing an electrolyte, presumably due to selective adsorption. In the Color Index system, directive dye refers to various planar, highly conjugated molecular structures that contain one or more anionic sulfonate group. Acid dye is a group of water soluble anionic dyes that is applied from an acidic solution. Reactive dye is a group of dyes containing reactive groups capable of forming covalent linkages with certain portions of the molecules of natural or synthetic fibers. From the chemical structure point of view, suitable fabric substantive dyes useful herein may be an azo compound, stilbenes, oxazines and phthalocyanines.

Suitable fabric substantive dyes for use herein include those listed in the Color Index as Direct Violet dyes, Direct Blue dyes, Acid Violet dyes and Acid Blue dyes.

In a specific embodiment, the fabric substantive dye is an azo direct violet 99, also known as DV99 dye having the following formula:

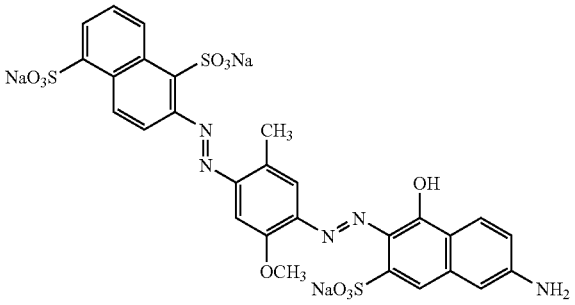

The fabric substantive dye is sprayed onto the particle carriers described below as a liquid dye or a dye solution in a solvent selected from the group consisting of water, alcohols, glycol ethers, glycols and glycerol. According to one embodiment herein, the fabric substantive dye is sprayed onto the particle carriers in the form of an aqueous solution comprising from about 5% to about 99.9%, or from about 10% to about 50% by weight of the fabric substantive dye. In one embodiment, the fabric substantive dye-loaded particle carrier comprises from about 0.001% to about 1%, preferably from about 0.01% to about 0.2% by weight of the fabric substantive dye.

Particle Carrier

The fabric substantive dye herein is loaded onto a particle carrier which is then added to the surfactant containing base powder of the fabric treatment composition. The particle carrier useful herein has an average particle size less than 100 μm, or from about 1 μm to about 50 μm, as measured by laser diffraction method. This average particle size range is of the particle carrier ensures an even distribution of the fabric substantive dye throughout the fabric treatment composition and prevents the occurrence of concentration of the fabric substantive dye and thus avoiding the staining problem on fabrics.

Particle carriers useful herein are solid granular materials generally found in laundry detergent compositions including but are not limited to zeolite, carbonate, sulfate, silicate, clay, phosphate, silica, citrate and mixtures thereof.

In one embodiment herein, the particle carrier is a zeolite selected from zeolite A, zeolite X, zeolite Y, zeolite MAP and mixtures thereof. The term "zeolite" used herein refers to a crystalline aluminosilicate material. The structural formula of a zeolite is based on the crystal unit cell, the smallest unit of structure is represented by $$Mm/n[(AlO_2)m(SiO_2)y].xH_2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

The aluminosilicate zeolite materials useful herein are commercially available. Methods for producing zeolites are well-known and available in standard texts. Preferred synthetic crystalline aluminosilicate materials useful herein are available under the designation of Type A, Type X or Type Y.

In yet another embodiment, the class of zeolites known as, "Zeolite MAP" may also be employed in the present invention. Such zeolites are disclosed and described in U.S. patent application Ser. No. 08/716,147 filed Sep. 16, 1996 and entitled, "Zeolite MAP and Alcalase for Improved Fabric Care."

After the fabric substantive dye is sprayed onto the particle carrier, the fabric substantive dye-loaded carrier is added to the surfactant containing base powder of the fabric treatment composition in an amount providing a fabric treatment composition comprising from about 0.01% to about 12%, or from about 0.05% to about 3% by weight of the fabric substantive dye-loaded carrier.

Other Components

The fabric treatment composition herein may comprise a variety of other components typically useful in laundry detergents and/or fabric softeners.

In one embodiment, the fabric treatment composition comprises, by weight, from about 5% to about 90%, or from about 5% to about 70%, or from about 5% to about 40% of a surfactant selected from the group consisting of an anionic, a nonionic, a cationic, a zwitterionic, an amphoteric surfactant and a mixture thereof. In a more specific embodiment, the detergent composition comprises anionic surfactant, nonionic surfactant, or mixtures thereof.

Suitable anionic surfactants useful herein can comprise any of the conventional anionic surfactant types typically used in liquid and/or solid detergent products. These include the alkyl benzene sulfonic acids and their salts as well as alkoxylated or non-alkoxylated alkyl sulfate materials. Exemplary anionic surfactants are the alkali metal salts of C10-16 alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium C11-C14, e.g., C12, LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: $R'—O—(C_2H_4O)n-SO_3M$ wherein R' is a C8-C20 alkyl group, n is from about 1 to 20, and M is a salt-forming cation.

Suitable nonionic surfactants useful herein can comprise any of the conventional nonionic surfactant types typically used in liquid and/or solid detergent products. These include alkoxylated fatty alcohols and amine oxide surfactants. Suitable alcohol alkoxylate nonionic surfactants useful herein may correspond to the general formula: $R1(C_mH_{2m}O)_nOH$, wherein R1 is a C8-C16 alkyl group, m is from 2 to 4, and n ranges from about 2 to 12. Another suitable type of nonionic surfactant useful herein comprises the amine oxide surfactants. Amine oxides are materials which are often referred to in the art as "semi-polar" nonionics. Amine oxides have the formula: R(EO)x(PO)y(BO)zN(O)($CH_2$R')2.qH2O. In this formula, R is a relatively long-chain hydrocarbyl moiety which can be saturated or unsaturated, linear or branched, and can contain from 8 to 20, or from 10 to 16 carbon atoms. R' is a short-chain moiety, preferably selected from hydrogen, methyl and —$CH_2$OH. When x+y+z is different from 0, EO is ethyleneoxy, PO is propyleneneoxy and BO is butyleneoxy. Amine oxide surfactants are illustrated by C12-14 alkyldimethyl amine oxide.

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, C8 to C18 (preferably C12 to C18) amine oxides and sulfo and hydroxy betaines, such as N-alkyl-N,N-dimethylammino-1-propane sulfonate where the alkyl group can be C8 to C18, preferably C10 to C14.

In another embodiment, the fabric treatment composition is a fabric softening composition comprising an effective amount of conventional or non-conventional fabric softening agent. Typical levels of the fabric softening agent in the fabric treatment composition herein are from about 1% to about 90%, or from about 5% to about 40%, or from about 12% to about 20% by weight of the composition.

In one embodiment, the fabric softening active is a diester quaternary ammonium (DEQA) Compound. A suitable DEAQ includes compounds of the formula:

$$\{R_{4-m}—N^+—[(CH_2)n\text{-}Y—R1]_m\}X^-$$

wherein each R substituent is either hydrogen, a short chain C1-C6, preferably C1-C3 alkyl or hydroxyalkyl group, e.g., methyl (most preferred), ethyl, propyl, hydroxyethyl, and the like, poly (C2-3 alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR— and it is acceptable for each Y to be the same or different; the sum of carbons in each R1, plus one when Y is —O—(O)C— or —NR—C(O)—, is C12-C22, preferably C14-C20, with each R1 being a hydrocarbyl, or substituted hydrocarbyl group; it is acceptable for R1 to be unsaturated or saturated and branched or linear and preferably it is linear; it is acceptable for each R1 to be the same or different and preferably these are the same; and X— can be any softener-compatible anion, preferably, chloride, bromide, methylsulfate, ethylsulfate, sulfate, phosphate, and nitrate, more preferably chloride or methyl sulfate.

In another embodiment, the fabric softening active is chosen from at least one of the following: ditallowoyloxyethyl dimethyl ammonium chloride, dihydrogenated-tallowoyloxyethyl dimethyl ammonium chloride, dicanola-oyloxyethyl dimethyl ammonium chloride, ditallow dimethyl ammonium chloride, tritallow methyl ammonium chloride, methyl bis(tallow amidoethyl)-2-hydroxyethyl ammonium methyl sulfate, methyl bis(hydrogenated tallow am idoethyl)-2-hydroxyethyl ammonim methyl sulfate, methyl bis(oleyl am idoethyl)-2-hydroxyethyl ammonium methyl sulfate, ditallowoyloxyethyl dimethyl ammonium methyl sulfate, dihydrogenated-tallowoyloxyethyl dimethyl ammonium chloride, dicanola-oyloxyethyl dimethyl ammonium chloride, N-tallowoyloxyethyl-N-tallowoylaminopropyl methyl amine, 1,2-bis(hardened tallowoyloxy)-3-trimethylammonium propane chloride, and mixtures thereof.

The fabric treatment compositions of the present invention may also comprise any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, optical brighteners and perfumes. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 0.01% to about 50%, more preferably from about 1% to about 30%, by weight of the composition.

Process

As noted previously, the fabric treatment composition herein may be provided in a solid form. Suitable solid forms include tablets and particulates, for example, granular particles or flakes. According to one embodiment of the present invention, the fabric substantive dye is loaded onto a particle carrier to provide a fabric substantive dye-loaded particle carrier which is then added into the surfactant containing base powder together with other dry-added materials and/or any other sprayed-on materials in a mixer to provide the finished fabric treatment composition. The surfactant containing base powder can be made by any suitable process known in the art, such as a standard spray-drying process or agglomeration process.

Where the fabric substantive dye is a liquid at the ambient temperature, the fabric substantive dye can be sprayed onto the particle carriers as is. Alternatively, the fabric substantive dye can be diluted with a proper solvent, such as water and then sprayed the dye solution onto the carriers. In one embodiment herein, the fabric substantive dye is diluted with water to give an aqueous dye solution comprising from about 5% to about 99.9%, or from about 10% to about 50% by weight of the fabric substantive dye. The aqueous dye solution is then sprayed onto the particle carriers in a mixer. There's no specific limitation on the type of mixer used herein, an illustrative mixer is a mechanical mixer, preferably a plough share mixer operated at an RPM of from about 20 to about 200, or from about 50 to about 150 and the mixing time is from about 1 minute to about 60 minutes, or from about 10 minutes to about 30 minutes. The above operation parameters are required to ensure the even loading of the fabric substantive dye onto the particle carriers.

In one embodiment herein, the surfactant containing base powder is prepared in a spray-dry tower or agglomeration process. Typical spray-dry tower or agglomeration process known in the art can be used in preparing the surfactant containing base powder. By way of example, see the processes described in U.S. Pat. No. 5,133,924, issued Jul. 28, 1992; U.S. Pat. No. 4,637,891, issued Jan. 20, 1987; U.S. Pat. No. 4,726,908, issued Feb. 23, 1988; U.S. Pat. No. 5,160,657, issued Nov. 3, 1992; U.S. Pat. No. 5,164,108, issued Nov. 17, 1992; U.S. Pat. No. 5,569,645, issued Oct. 29, 1996.

The surfactant containing base powder is then charged into a mixer. The fabric substantive dye-loaded particle carriers and any other dry-added materials as well as sprayed-on materials are added into the mixer by a known process. A suitable mixer useful for this process can be a continuous cylindrical drum or equipments marketed under the tradename FORBERG™ and the mixer can be operated in a normal manner.

The fabric treatment compositions of this invention, prepared as hereinbefore described, can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith. The present fabric treatment compositions comprising a fabric substantive dye loaded onto a particle carrier have been found to exhibit good tinting efficiency during a laundry wash cycle without exhibiting undesirable staining problems.

Test Method

Test on Fabric Staining Caused by Fabric Substantive Dye

Place a cellulose sponge in a water reservoir, keep the sponge saturated with water across the whole test period. Place swatches (10×10 cm) of tested fabric (eg. heavy cotton) on the sponge, ensure the fabric is wet throughout the test. Evenly spread 20 g of a fabric treatment composition containing a fabric substantive dye across the wet swatches and allow the fabric treatment composition to stand on the wet swatches for 2 hours. After 2 hours, remove the swatches from the cellulose sponge, soak the swatches in clean water and then rinse for one time. If staining spots caused by the fabric substantive dye are visible on the swatches, manually scrub 25 times of the swatches and then line dry the swatches. After the swatches are dried, check if there are any staining spots caused by the fabric substantive dye on the swatches by an observer.

Test on Coloration of Fabric Substantive Dye on Finished Fabric Treatment Composition Measure the Hunter L, a, b scale of a product without containing fabric substantive dye and a product of similar composition but containing fabric substantive dye by a Colorimeter (Model: Hunter LabscanXE, Illuminant=C, Observer=2 degrees). The Hunter L, a, b scale of the product without containing the fabric substantive dye are recorded as standard and the Hunter L, a, b scale of the product containing a fabric substantive dye are recorded as sample. The difference between the standard L, a, b scale and sample L, a, b scale is recorded as ΔL, Δa and Δb. ΔE between the sample and standard products is calculated according to the following equation:

$$\Delta E=\sqrt{\Delta L^2+\Delta a^2+\Delta b^2}$$

A ΔE value of less than 4.6, or preferably less than 3.5 is an acceptable color change of the fabric treatment composition to consumers.

EXAMPLES

The following examples illustrate the present invention but are not necessarily meant to limit or otherwise define the scope of the invention herein.

An aqueous dye solution comprising 14% by weight of direct violet 99 (DV99) fabric substantive dye is prepared. Dyed carrier is made by spraying the aqueous dye solution into a KM100 mixer charged with Zeolite A having an average particle size of about 2-6 μm. The KM100 mixer is running at 176 rpm and the mixing time is 30 minutes. The dyed carrier compositions obtained are shown in below Table 1.

TABLE 1

| Dyed Carrier Composition | Example | |
|---|---|---|
| | 1 | 2 |
| DV99 | 0.12% | 0.03% |
| Water | 0.74% | 0.18% |
| Zeolite A | 99.14% | 99.79% |

The dyed carrier is added to surfactant containing base powder obtained by a standard spray dry process. The surfactant containing base powder is a granular laundry detergent having the following composition shown as Comparative Example 1.

| | Comparative Example 1 |
|---|---|
| NaLAS | 20.5 |
| Sodium sulphate | 44.31 |
| Sodium carbonate | 9.4 |
| Sodium silicate | 8.3 |
| Sodium tripolyphospahte | 3 |
| savinase | 0.36 |
| polymer | 1 |
| carboxymethylcellulose | 0.13 |
| Perfume | 0.19 |
| Sodium Polyacrylate | 0.51 |
| DTPA | 0.2 |
| Fluorescent Whitening agent | 0.1 |
| Photobleach | 0.001 |
| Type A zeolite | 8 |
| Water and miscellaneous | Balance to 100 |

0.83 g of dyed carrier 1 and 6.64 g of dyed carrier 2 are added to 500 g of the granular laundry detergent composition of the Comparative Example 1 separately to give granular laundry detergent compositions having the following level of DV99 and DV99 loaded carrier:

| | Example | |
|---|---|---|
| | 1 | 2 |
| DV99 | 0.0002% | 0.0004% |
| DV99-loaded carrier | 0.17% | 1.33% |

Tests on staining on fabrics caused by the fabric substantive dye are run using the granular laundry detergent compositions of the above Examples 1 and 2 according to the test method described hereinabove. No staining spots caused by DV99 are observed on the tested heavy cotton swatches.

Tests on the coloration of fabric substantive dye on the finished fabric treatment composition are run using the granular laundry detergent compositions of the above Examples 1 and 2 as samples and the granular laundry detergent composition of the above Comparative Example 1 as standard according to the test method described hereinabove. Results are shown in the below Table 2:

TABLE 2

| | L | a | b | Delta E |
|---|---|---|---|---|
| Comparative Example 1 | 93.82 | 0.33 | 1.95 | Not applicable |
| Example 1 | 92.45 | 1.99 | 1.44 | 2.2 |
| Example 2 | 91.63 | 1.88 | 0.12 | 3.2 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A granular laundry detergent composition, comprising from about 0.0001% to about 0.005% by weight of a fabric substantive dye, wherein the fabric substantive dye is loaded onto a particle carrier having an average particle size of less than 100 μm, and wherein the fabric treatment composition comprises from about 0.01% to about 12% by weight of the fabric substantive dye-loaded particle carrier; wherein the fabric substantive dye comprises a compound having the following formula:

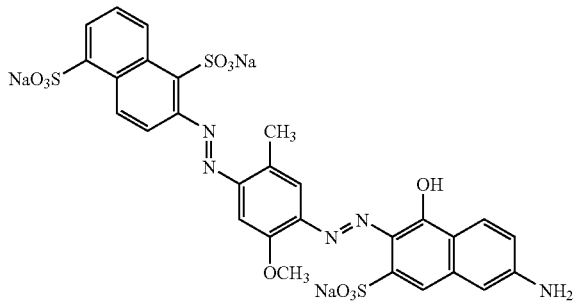

and wherein the particle carrier is selected from the group consisting of a zeolite, a carbonate, a sulfate, a silicate, a clay, a phosphate, a silica, a citrate and mixtures thereof.

2. The granular laundry detergent composition of claim 1, wherein the particle carrier is zeolite having an average particle size of from about 1 μm to about 50 μm.

3. The granular laundry detergent composition of claim 1, wherein said fabric treatment composition is a granular laundry detergent composition comprising from about 0.0001% to about 0.001% by weight of said fabric substantive dye and from about 0.05% to about 3% by weight of said fabric substantive dye-loaded particle carrier.

4. The granular laundry detergent composition of claim 3, wherein said granular laundry detergent composition has a color change of, ΔE, of less than about 4.6 compared to a laundry detergent composition not containing the fabric substantive dye-loaded particle carrier.

5. A process for making the granular laundry detergent composition of claim 1 comprising the steps of spraying a solution of said fabric substantive dye onto said particle carrier and mixing to provide a fabric substantive dye-loaded particle carrier and adding the fabric substantive dye loaded-particle carrier into a surfactant containing base powder of the fabric treatment composition.

6. The process of claim 5, wherein said solution of the fabric substantive dye is sprayed onto the particle carrier in a plough share mixer.

7. The process of claim 5, wherein said plough share mixer is operated at an RPM of from about 20 to about 200 and the mixing time is from about 1 minute to about 60 minutes.

8. A method for imparting a hue to a fabric comprising the step of contacting the fabric with an aqueous solution of the granular laundry detergent composition of claim 1.

* * * * *